US006633133B1

(12) United States Patent
Ishida

(10) Patent No.: US 6,633,133 B1
(45) Date of Patent: Oct. 14, 2003

(54) ION SOURCE

(75) Inventor: Shuya Ishida, Kyoto (JP)

(73) Assignee: Nissin Electric Co., Ltd., Kyoto (JP)

( * ) Notice: Subject to any disclaimer, the term of this patent is extended or adjusted under 35 U.S.C. 154(b) by 0 days.

(21) Appl. No.: 09/621,447

(22) Filed: Jul. 21, 2000

(30) Foreign Application Priority Data

Jul. 22, 1999 (JP) ..... 11-207562
Dec. 21, 1999 (JP) ..... 11-363278

(51) Int. Cl.[7] ..... H01J 7/24

(52) U.S. Cl. ..... 315/111.81; 315/111.21; 118/723 HC

(58) Field of Search ..... 315/111.21, 111.81, 315/111.51, 111.71; 427/523; 313/230; 219/121.59; 118/723 I, 723 HC

(56) References Cited

U.S. PATENT DOCUMENTS 4,422,888 A * 12/1983 Stutius ..... 148/175
4,496,843 A 1/1985 Kirita et al. ..... 250/426
4,886,971 A * 12/1989 Matsumura et al. .... 315/111.81
5,049,784 A * 9/1991 Matsudo ..... 315/111.81
5,126,206 A * 6/1992 Garg et al. ..... 428/408
5,296,713 A * 3/1994 Tanaka ..... 315/111.81
5,554,222 A * 9/1996 Nishihara et al. ..... 118/723 HC
5,693,376 A * 12/1997 Fetherston et al. ..... 427/523

FOREIGN PATENT DOCUMENTS

JP A-3-13576 1/1991
JP 9-35648 2/1997 ..... H01J/27/02

OTHER PUBLICATIONS

Decision of Refusal with partial English translation of "The Electron and Ion Beam Handbook," by Nippon Gakujutsu Shinkokai, Committee No. 132, Nikkan Kogyo Sinbunsha (1973), p. 77.
Notification of Reason(s) for Refusal with partial English translation of JP–A–57–201527.
Office Action issued by Korean Patent Office, dated Dec. 10, 2002.

* cited by examiner

*Primary Examiner*—Don Wong
*Assistant Examiner*—Jimmy T. Vu
(74) *Attorney, Agent, or Firm*—Finnegan, Henderson, Farabow, Garrett & Dunner LLP

(57) ABSTRACT

An ion source is furnished with a gas introducing mechanism for introducing an inert gas and an organometallic gas being a raw gas into a plasma production container.

6 Claims, 5 Drawing Sheets

Prior Art

ION SOURCE

BACKGROUND OF THE INVENTION

1. Field of the Invention

The present invention relates to an ion source to be used to an ion implantation apparatus for producing, for example, a semi-conductor device, using an organometallic gas as a raw gas.

2. Description of the Related Art

This kind of a conventional ion source is shown in FIG. 3. The similar ion source as this is described in JP-A-9-35648.

This ion source is called as an electron impact ion source, and more specifically a Bernus type ion source. The ion source is furnished with a plasma production container 2 also serving as an anode, a filament 8 (hot cathode) equipped at one side within the plasma production container 2, a reflecting electrode 10 equipped at the other side within the same, and an ion leading slit 4 provided in the wall of the plasma production container 2. In the vicinity of an outlet of the ion leading slit 4, a leading electrode 14 is provided for leading ion beam 16 from the plasma 12 produced within the plasma production container 2. Outside of the plasma production container 2, a magnetic field generator 18 is disposed for generating magnetic field B in the axial direction thereof. Numerals 24 and 25 designate insulating materials.

Into the plasma production container 2, an organometallic gas 28 is introduced as a raw gas (source gas) for making a plasma 12 and ion beam 16. The organometallic gas 28 is introduced through a gas-introducing inlet 6 provided in the wall of the plasma production container 2 and a gas introducing pipe 26 connected thereto.

The organometallic gas 28 is, for example, gaseous trimethylindium [$In(CH_3)_3$], triethylindium [$In(C_2H_5)_3$], trimethylgallium [$Ga(CH_3)_3$], triethylgallium [$Ga(CaH_5)_3$] or trimethylantimony [$Sb(CH_3)_3$].

In such an ion source, the inside and the outside of the plasma production container 2 is air-exhausted by vacuum. The filament 8 is heated by a filament electric source 20. The organometallic gas 28 is introduced into the plasma production container 2. An arc discharging voltage from an arc source 22 is applied between the filament 8 and the plasma production container 2. The arc discharge is generated between the filament 8 and the plasma production container 2. Thus, the organometallic gas 28 is ionized to generate the plasma 12. Then, the ion beam 16 can be led from this plasma 12. For example, when the organometallic gas 28 is used as the raw gas, the ion beam 16 containing indium ion or gallium ion can be led.

The reflecting electrode 10 repulses electron emitted from the filament 8 to serve as heightening ionization efficiency of the gas and generation efficiency of the plasma 12.

There are many cases that the organometallic gas 28 has strong reactivity by itself (trimethylindium is in this case) and that activated molecule or activated atom generated by changing the organometallic gas 28 into the plasma have strong reactivity. In the ion source where the organometallic gas 28 is introduced as it is into the plasma production container 2, there are problems that (1) parts such as the filament 8, reflecting electrode 10 and insulating materials 24, 25 in the plasma production container 2 are affected with quality alteration, whereby the amount of generating the plasma and the amount of generating the ion beam are altered so that lives of these parts are shortened, (2) dirt is easy to occur in the plasma production container 2, and by the dirt, insulating failures arise between the filament 8 and the plasma production container 2 and other parts, thereby resulting to disturb the stable actuation of the ion source, and (3) maintenance (disassembly, cleaning or the like) should be frequently done for removing the dirt.

To explain more specific examples, if the organometallic gas 28 is trimethylindium gas, there are following problems.

(1) The insulating capacity between the filament 8 and the plasma production container 2, more specifically of the insulating material 24 decreases by carbon occurring by decomposition of trimethylindium. Accordingly, the arc discharging voltage cannot be normally applied therebetween, and the amount of generating the plasma 12 and the amount of generating the ion beam 16 are altered to be unstable. The electron reflecting actuation at the reflecting electrode 10 is altered to be unstable also by decreasing of the insulating capacity of the insulating material 25 for the reflecting electrode 10. The amount of generating the plasma 12 and the amount of generating the ion beam 16 are made unstable.

(2) The filament 8 at high temperature is hydrogenated or carbonized and effected with quality alteration by activated hydrogen or activated carbon occurring through decomposition of trimethylindium. The amount of generating thermoelectron from the filament 8 is changed thereby, and the generating amount of the plasma 12 is changed and the generating amount of the ion beam 16 is changed correspondingly. The life of the filament 8 is also shortened.

(3) The filament 8 is embrittled by the activated hydrogen or the activated carbon occurring through brittleness decomposition of trimethylindium, and the amount of generating the thermo-electron from the filament 8 is changed. Thereby, the generating amount of the plasma 12 is changed and the generating amount of the ion beam 16 is also changed. The life of the filament 8 is shortened.

(4) For stabilizing and continuing the plasma 12 with only the trimethylindium gas being the raw gas, it is necessary to supply the trimethylindium gas more than required (that is, more than the amount required for obtaining a desired amount of the indium ion beam). Therefore, excessive indium or carbon existing in the plasma production container 2 increases, and dirt therein becomes larger. The interior of the plasma production container 2 should be frequently cleansed, otherwise the stable actuation of the ion source will be difficult.

(5) Since it is necessary to supply the trimethylindium gas more than required for stabilizing and continuing the plasma 12, the interior of the gas introducing pipe 26 is contaminated and easily clogged by indium metal caused by thermal decomposition of the gas before being supplied into the plasma production container 2. As a result, the stable supply of trimethylindium gas is difficult, and the production amount of the ion beam 16 becomes unstable.

Also in the case of the above-mentioned organometallic gases 28 other than the trimethylindium gas, similar problems arise as (1) to (2).

Furthermore, recently, attention has been paid to an indium ion implantation to substrates of a semi-conductor (for example, a silicone substrate or gallium arsenic substrate).

As an ion source to be used to, for example, such purposes, there is an ion source of so-called hot cathode type which uses the thermoelectron generated from the filament (hot cathode) so as to ionize a raw gas containing indium in the plasma production container for leading ion beam containing indium ion.

In a case that a gasified material of such as indium chloride ($InCl_3$) is used as the raw gas to the ion source, there will arise problems as follows. Namely, since such compounds have deliquescence (property becoming liquid by absorption of moisture from the air), the inner wall of the plasma production container is instantly contaminated by melted substances. Accordingly, it is difficult to air-exhaust by vacuum the interior of the plasma production container and to produce the plasma. In addition, since acid is generated by melting, the inner wall of the plasma production container is corroded. Many troubles are taken for cleansing melted materials.

In a case that gasified materials of such as metallic indium (In) are used as the raw gas, since these materials are low in a steam pressure, there will occur a problem that an oven of high temperature for gasification (for example, heating temperature is around 800 to 1000° C.).

On the other hand, trimethylindium [$In(CH_3)_3$] or triethylindium [$In(C_2H_5)_3$] are high in the steam pressure to a certain extent. Therefore, it is not necessary to use the high temperature oven for gasification. As they have no deliquescence, the inner wall of the plasma production container is neither contaminated nor corroded. Because of such merits, it is very convenient to use these gases as the raw gas.

However, it was found that when the trimethylindium gas or the triethylindium gas was used as the raw gas in the ion source of the hot cathode type as above mentioned for leading the ion beam containing the indium ion, the filament was deteriorated in a short time (around 1 to several hours) and the serving live thereof ceased. For the filament, a wolfram filament ordinarily used in the ion source was used.

The deterioration process of the filament was examined as follows. As an example shown in FIG. 5, many voids (air holes) occur in the interior and surface of the filament 30, so that the surface is made rugged. When these voids occur and grow, a distribution in surface temperature of the filament 30 when driving the ion source gradually, becomes non-uniform, and at the same time, local deterioration of the filament 30 advances thereby, and one portion 34 is made thin. The non-uniformity in the temperature distribution further progresses, the portion 34 becomes rapidly thin, and consequently, the life of the filament 30 is acceleratedly shortened and goes to breaking of wire.

It was seen that when the trimethylindium gas or the triethylindium gas was used as the raw gas, much merit were available as mentioned above, but on the other hand, there was a serious problem that the life of the filament was short.

SUMMARY OF THE INVENTION

It is an object of the present invention to enable to stabilize actuation of the ion source, stabilize the amount of generating the ion beam, lengthen lives of composing parts and make maintenance easy.

It is another object of the present invention to enable to lengthen the life of the filament while making the best use of the merit of employing the trimethylindium gas or the triethylindium gas as the raw gas.

The ion source of the present invention comprising a gas introducing mechanism for introducing an inert gas and the organometallic gas into a plasma production container.

By the gas introducing mechanism, it is possible to introduce the inert gas and the organometallic gas being the raw gas into the plasma production container. As a result, the flowing amount of the organometallic gas can be lessened while securing the flowing amount of total gas necessary for stabilizing and continuing the plasma in the plasma production container and the amount of the ion beam by the sort of a desired ion.

Consequently, various problems arising in company with using of the organometallic gas can be reduced, and it is possible to enable to stabilize the actuation of the ion source, stabilize the amount of generating the ion beam, lengthen lives of composing elements and make maintenance easy.

Further, in the ion source of the present invention, a raw gas is trimethylindium gas or the triethylindium gas, and the filament comprises tantalum.

In the above mentioned gases other than the trimethylindium gas or the triethylindium gas, the rapid deterioration phenomenon of the wolfram filament was not seen. Therefore, this is considered as a phenomenon particular to the combination of the wolfram filament and the trimethylindium gas or the triethylindium gas.

Contemplating the reason therefor, it is assumed that activated hydrogen or activated carbon are generated by changing the trimethylindium gas or the triethylindium gas into plasmas, and they invade between metallic crystals of the wolfram filament heated at high temperature by their serving as the hot cathode, whereby many voids appear in the interior or the surface of the wolfram filament.

On the other hand, forming the filament with tantalum (Ta), it was confirmed that the live was very lengthened in comparison with wolfram (around 5 to 6 times as later mentioned).

Contemplating the reason therefore, it is assumed that the tantalum filament can occlude the activated hydrogen or the activated carbon as maintaining the state of metallic crystal. Therefore, voids are hard to occur in comparison with the wolfram filament. Tantalum can occlude hydrogen as 740 volume under e.g., a black-red heat, in other words, Tantalum can occlude 740 times as much hydrogen as its volume when is heated to glow black-red.

BRIEF DESCRIPTION OF THE INVENTION

PREFERRED EMBODIMENTS OF THE INVENTION

Preferred embodiments according to the present invention will be described as follows referring to the accompanying drawings.

Figure 1:
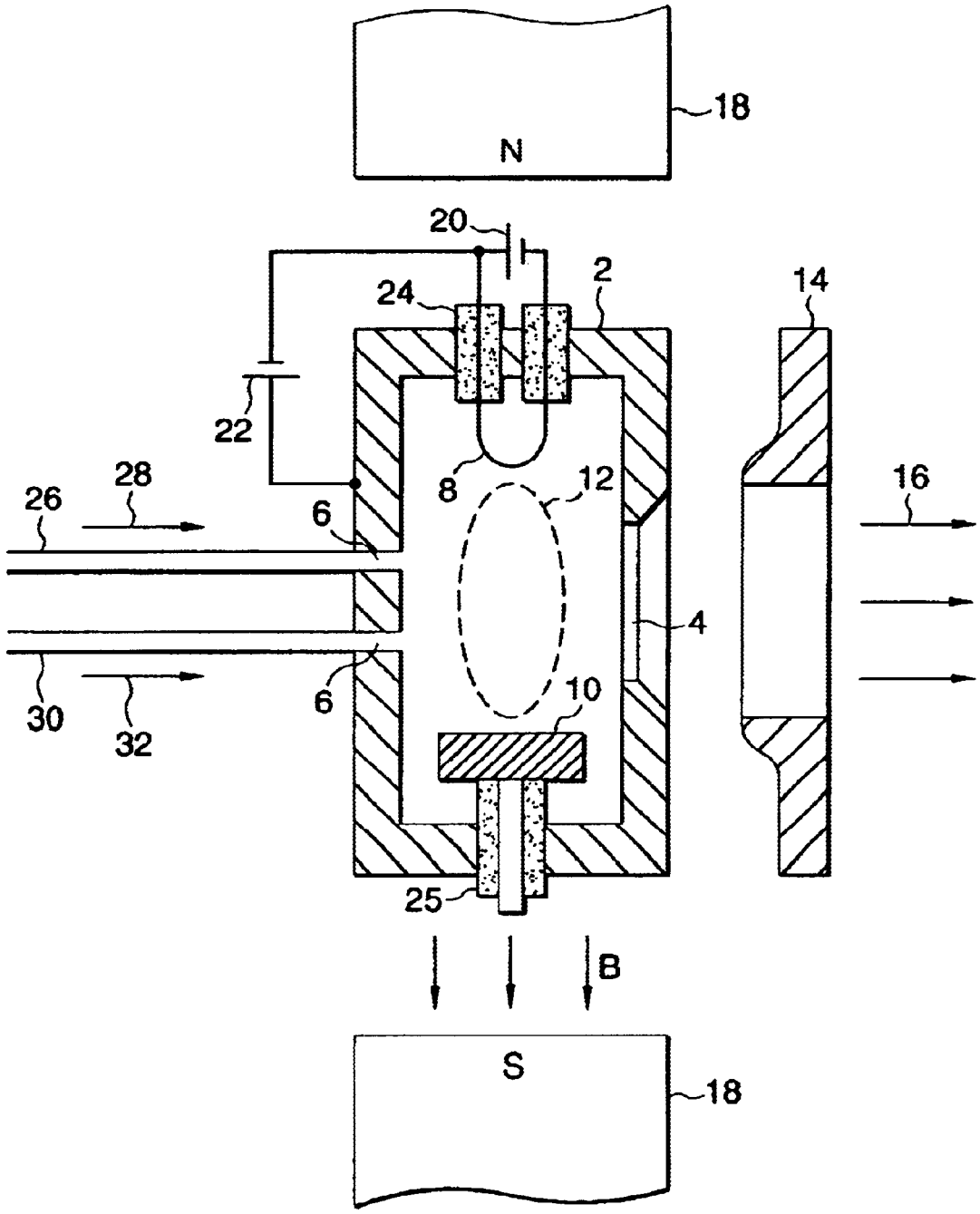
FIG. 1 is a cross sectional view showing one embodiment of the ion source according to the present invention.
Figure 3:
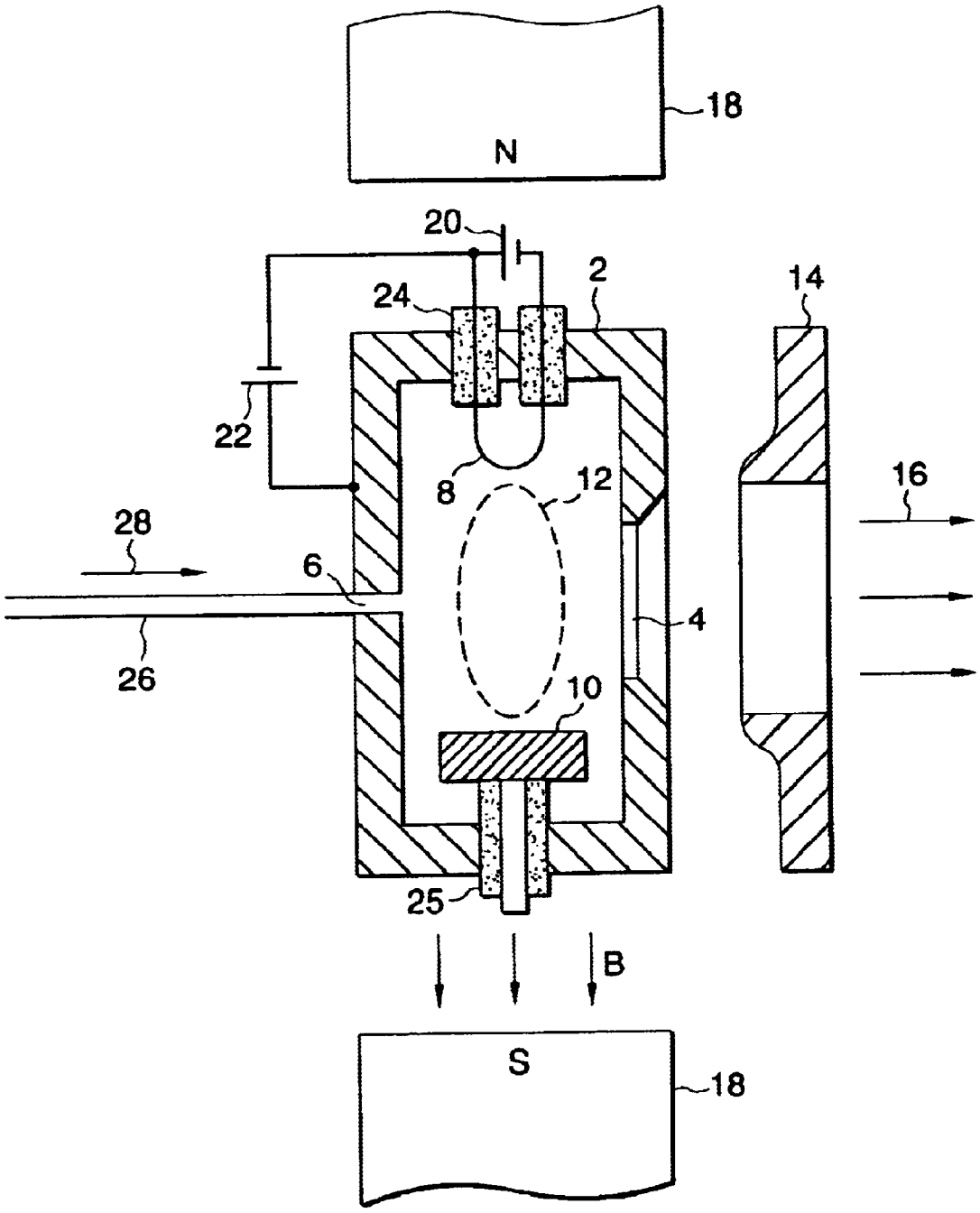
FIG. 3 is a cross sectional view showing a conventional ion source.

FIG. 1 is a cross sectional view showing one embodiment of the ion source according to the invention. The same numerals and signs are given to the same or corresponding parts of the conventional one shown in FIG. 3, and in the following description, different regards from the conventional example will be mainly referred to.

This ion source is furnished with two gas introducing inlets 6 equipped in the wall of the plasma production container 2 as gas introducing mechanisms for introducing an inert gas 32 together with the organometallic gas 28 into the plasma production container 2, and gas introducing pipes 26 and 30 connected to the respective gas introducing inlets 6 so as to introduce the organometallic gas 28 and the inert gas 32 via the respective gas introducing inlets 6 into the plasma production container 2. This gas introducing mechanisms are, in brief, for separately introducing the organometallic gas 28 and the inert gas 32.

The inert gas 32 is He, Ne, Ar, Kr, Xe or Rn, and they are also called as rare gases. Mixed gases of two or more kinds are sufficient. These inert gases 32 are preferable because even if introducing into the plasma production container 2 at high temperature, no compound is formed by reacting with materials composing the filament 8 or the plasma production container 2 (for example, Ta, W, Mo or Nb).

Depending on this ion source, when driving it (that is, when leading the ion beams 16), it is possible to introduce the inert gas 32 together with the organometallic gas 28 being the raw gas into the plasma production container 2 by the gas introducing mechanism. Namely, the mixed gas of the organometallic gas 28 and the inert gas 32, in other words, a gas formed by diluting the inert gas 32 with the organometallic gas may be used for generating the plasma 12.

Consequently, the flowing amount of the organometallic gas can be lessened while securing the flowing amount of total gas (that is, total of the organometallic gas 28 and the inert gas 32) necessary for stabilizing and continuing the plasma 12 in the plasma production container 2 and the amount of the ion beam by the sort of the desired ion (for example, indium ion). As a result, the above mentioned various problems arising in company with using of the organometallic gas can be reduced.

This fact will be explained as follows, referring to the cases that the organometallic gas 28 is trimethylindium gas and the inert gas 32 is an argon gas.

(1) Since the amount of supplying the trimethylindium gas can be reduced without spoiling the stable continuation of the plasma 12, the carbon amount generating by decomposition of trimethylindium in the plasma production container 2 becomes reduced. Accordingly, it is possible to reduce lowering of the insulating capacity of the insulating material 24 between the filament 8 and the plasma production container 2 or the insulating material 25 between the reflecting electrode 10 and the plasma production container 2. Thus, the amount of generating the plasma 12 and the amount of generating the ion beam 16 may be stabilized.

(2) Since the amount of supplying the trimethylindium gas can be reduced without spoiling the stable continuation of the plasma 12, the amount of the activated hydrogen or activated carbon generating by decomposition of trimethylindium in the plasma production container 2 becomes small. Accordingly, it is possible to reduce the degree that the filament 8 at high temperature is hydrogenated or carbonized and effected with quality alteration. As a result, the amount of generating thermoelectron from the filament 8 is stable, and the amount of generating the plasma 12 and the amount of generating the ion beam 16 may be stabilized. The life of the filament 8 is also lengthened.

(3) Since the amounts of the activated hydrogen and activated carbon generating by decomposition of trimethylindium becomes small, the degree that the filament 8 is embrittled is lightened. Thus, the amount of generating thermoelectron from the filament 8 is stable and the amount of generating the plasma 12 and the amount of generating the ion beam 16 may be stabilized. The life of the filament 8 is also lengthened.

(4) Since the amount of supplying the trimethylindium gas can be reduced without spoiling the stable continuation of the plasma 12, the trimethylindium gas is sufficient with an amount necessary to obtain a desired amount of the indium ion beam (beam current). Accordingly, the generation of the excessive indium or carbon in the plasma production container 2 may be moderated. As a result, since the contamination is few at the interior of the plasma production container 2, the actuation of the ion source can be stabilized. Further, maintenance as cleaning the interior of the plasma production container 2 can be simplified.

(5) Since the amount of supplying trimethylindium gas can be reduced without spoiling the stable continuation of the plasma 12, the trimethylindium gas more than necessary is not needed to be supplied. Accordingly, it may be reduced that the interior of the gas introducing pipe 26 is contaminated and easily clogged by the indium metal generated by thermal decomposition of said gas before being supplied into the plasma production container 2. Therefore, the stable supply of the trimethylindium gas is possible, and the amount of generating the ion beam 16 is stabilized.

Also in the case of the above mentioned organometallic gases 28 other than the trimethylindium gas, similar effects may be obtained as (1) to (5).

Figure 2:
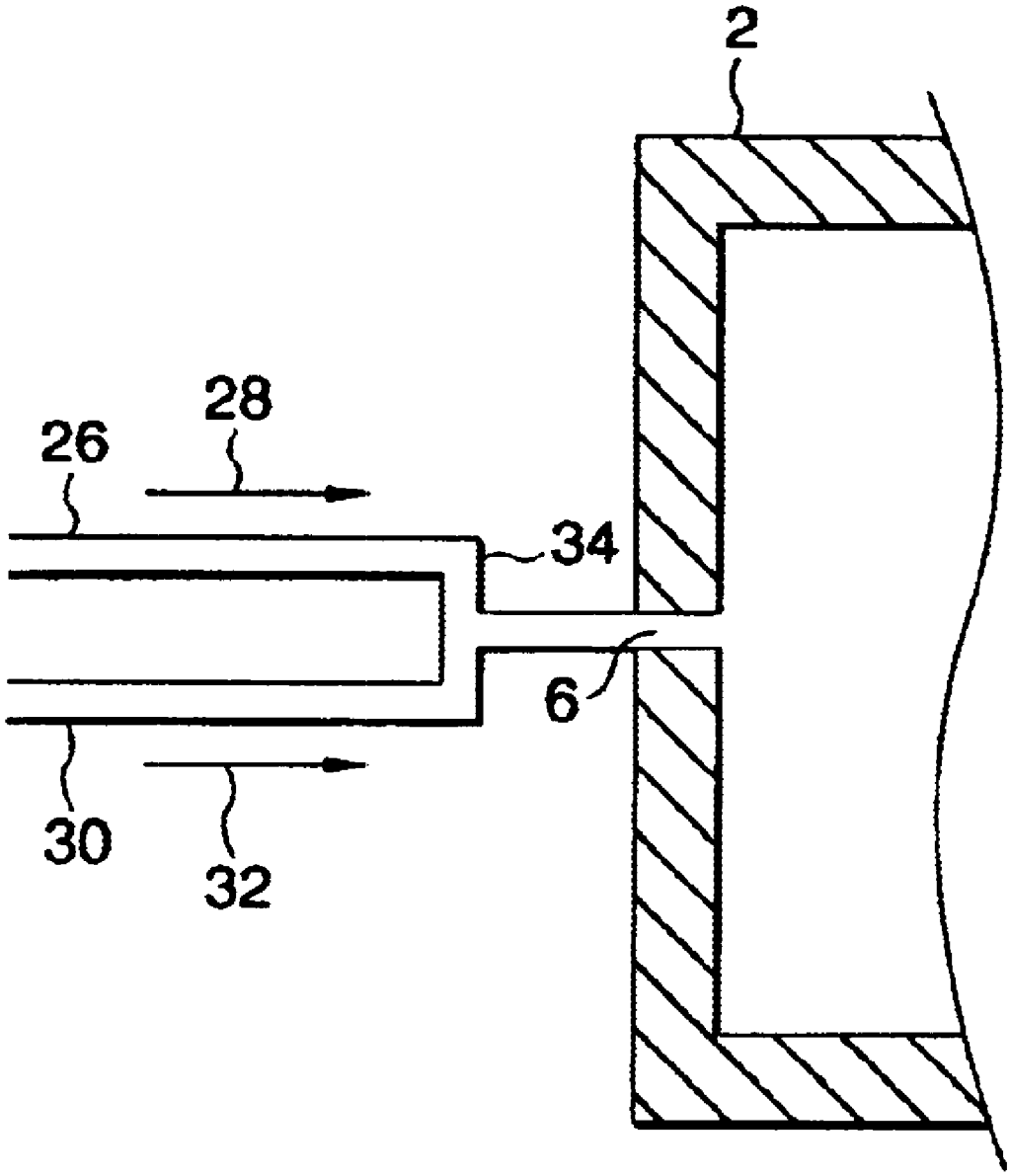
FIG. 2 is a cross sectional view partially showing a circumference of the gas introducing mechanism of the other example of the ion source according to the invention.

The gas introducing mechanism for introducing the inert gas 32 together with organometallic gas 28 into the plasma production container 2 is sufficient with such as an embodiment shown in FIG. 2. In this embodiment, one gas introducing inlet 6 is provided in the wall of the plasma production container 2, and the two gas introducing pipes 26 and 30 are connected to the gas introducing inlet 6 via a mixing part 34. This gas introducing mechanism is, in brief, for previously mixing the organometallic gas 28 and the inert gas 32 (that is, before the plasma production container 2) and introducing into the plasma production container 2.

The embodiment of FIG. 2 exhibits similar acting effects as the example of FIG. 1.

If the plasma 12 is generated under the condition that the inert gas 32 is mixed, although an inert gas ion is contained in the ion beams 16, there is not any special problem. This is because the desired ion sort (for example, indium ion) is ordinarily selected through a mass separator for carrying out an ion implantation to a target (for example, a substrate).

The present invention is not limited to the above mentioned Bernus type ion source, but may be broadly applied to other ion sources, for example, electron impact types such as Kaufmann, Freeman, PIG, or bucket (multi electrode magnetic field type) types.

According to the above embodiments of the present invention, the ion source is furnished with the gas introducing mechanism for introducing the inert gas together with the organometallic gas being the raw gas into the plasma production container. Accordingly, the flowing amount of the organometallic gas may be lessened. Further, it is possible to secure the flowing amount of the total gas necessary for stabilizing and continuing the plasma in the plasma production container 2 and the amount of the ion beam by a sort of the desired ion.

Consequently, various problems arising in company with using the organometallic gas may be moderated. As a result, it is possible to stabilize actuation of the ion source, stabilize the amount of generating ion beam, lengthen lives of composing elements and make maintenance easy.

Figure 4:
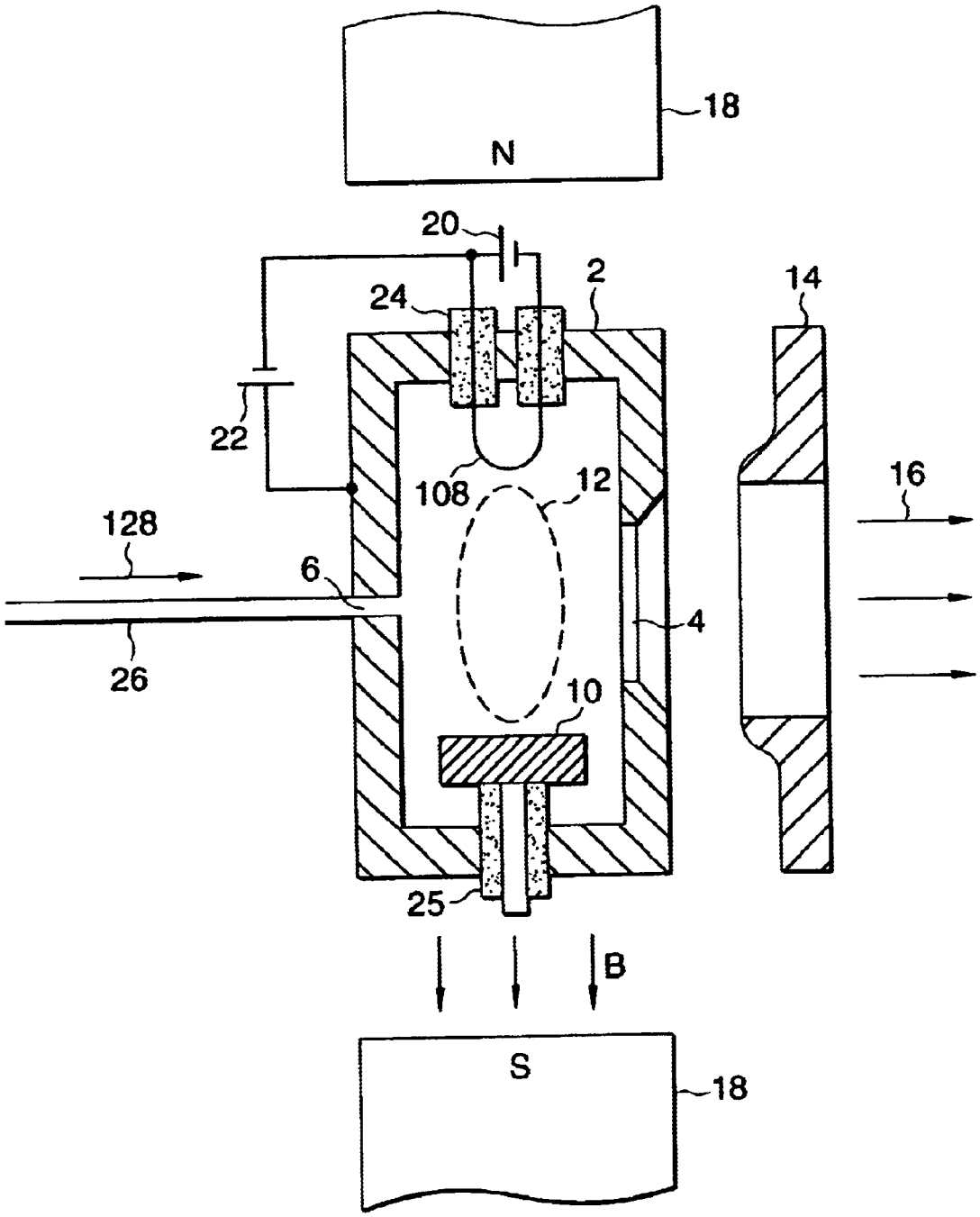
FIG. 4 is a cross sectional view showing one embodiment of the ion source according to the present invention.
Figure 5:
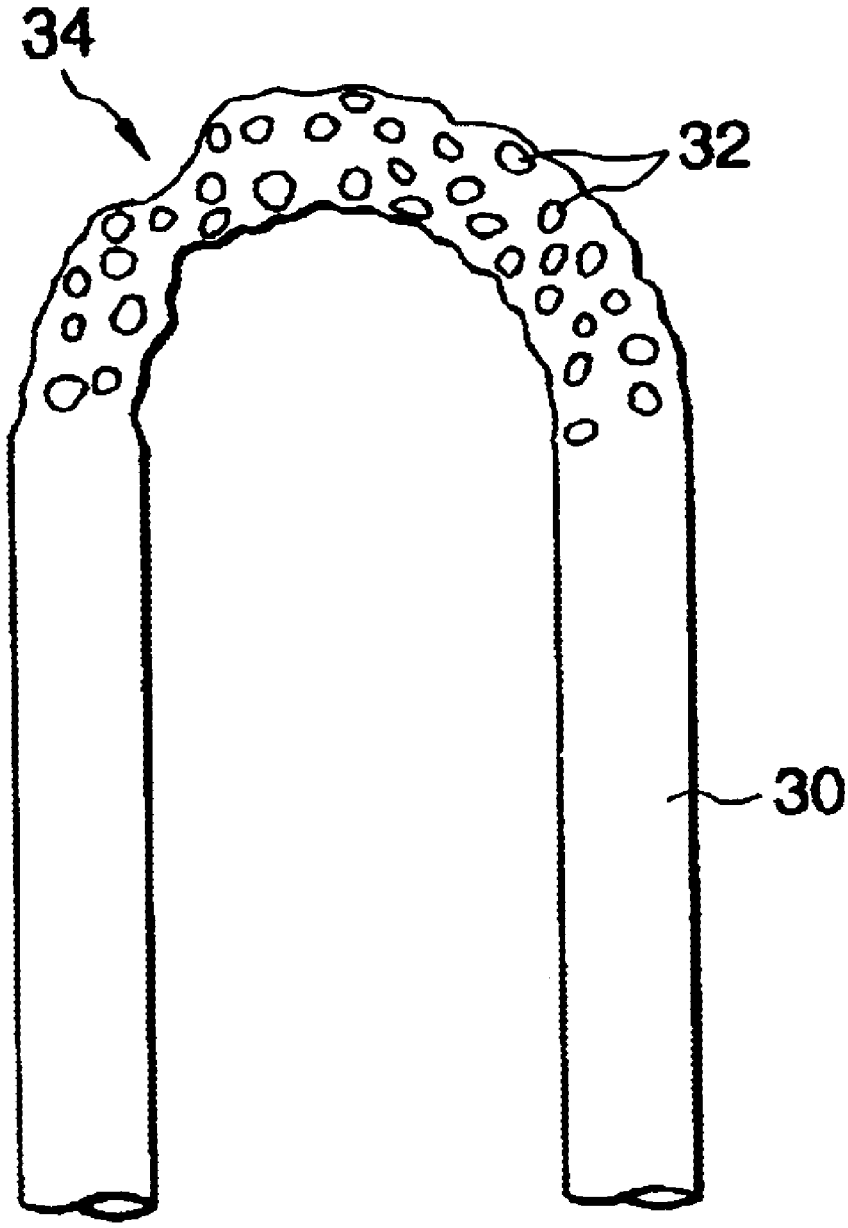
FIG. 5 is a view schematically showing one example of the filament, the surface of which is made rugged by occurrence of voids in the related art.

FIG. 4 is a cross sectional view showing one embodiment according to the invention. The same numerals and signs are given to the same or corresponding parts of the embodiment shown in FIG. 1 and the conventional one shown in FIG. 3, and in the following description, different regards from the conventional example will be mainly referred to.

The filament 108 in this embodiment is composed of tantalum. As a comparing example, experiments were made on the filament composed of the conventional wolfram.

Into the plasma production container 2, a raw gas 128 is introduced as the raw gas (source gas) for producing the plasma 12 and the ion beam 16 through a gas introducing inlet 6 and a gas introducing pipe 26 connected thereto. For the raw gas 128, the trimethylindium gas is employed in this embodiment.

In such an ion source, the inside and the outside of the plasma production container 2 are air-exhausted by vacuum. The filament 108 is heated by a filament electric source 20 so as to generate thermoelectron. The raw gas 128 of an appropriate flowing amount is introduced into the plasma production container 2. An arc discharging voltage from an arc source 22 is applied between the filament 8 and the plasma production container 2, so that the arc discharge is generated between the filament 8 and the plasma production container 2. Then, the raw gas 128 is ionized to generate the plasma 12. Thus, the ion beam 16 can be led from this plasma 12.

The reflecting electrode 10 repulses electron emitted from the filament 8 to serve as heightening ionization efficiency of the gas and generation efficiency of the plasma 12.

When comparing lives of the filaments 8 in such an ion source, the life of the conventionally used wolfram filament was 1 to several hours, while the life of the tantalum filament was 30 to 40 hours or longer. Namely, it was confirmed that if the tantalum filament was employed, the life would be 5 to 6 times of the wolfram filament.

The trimethylindium gas used as the raw gas is high in the steam pressure to a certain extent as mentioned above. Thus, it is not necessary to use the high temperature oven for gasification. For example, the gasification can be provided to a degree of vacuum leading of the container supporting a solid trimethylindium therein at room temperature. Besides as it has no deliquescence, the inner wall of the plasma production container is neither contaminated nor corroded. Accordingly, a stable operation of the ion source is available, the life of the ion source is long, and the maintenance such as cleaning can be simplified.

Since the triethylindium gas is an organometallic gas of the same kind as the trimethylindium gas, similar effects may be brought about also when the raw gas 28 is the triethylindium gas.

The raw gas 28, that is, the trimethylindium gas or the triethylindium gas may be introduced as a sole gas into the plasma production container 2 or together with inert gases (rare gases) such as Ar, Ne and others. If introducing together with the inert gas, the flowing amount of the raw gas can be lessened while securing the flowing amount of total gas (that is, total of the raw gas 28 and the inert gas 32) necessary for stabilizing and continuing the plasma 12 in the plasma production container 2 and the amount of the ion beam by the desired indium ion. Further, it is possible to decrease influences to the filament 8 by the raw gas 28, thereby enabling to lengthen the life of the filament 8.

The present invention is not limited to the above mentioned Bernus type ion source, but may be broadly applied to other ion sources having filaments, for example, electron impact types such as Kaufmann, Freeman, bucket (multi electrode magnetic field type) types or hot cathode PIG type.

According to the invention, it is possible to lengthen the life of the filament while making the best use of the merit of employing the trimethylindium gas or the triethylindium gas as the raw gas, that is, not requiring to use the high temperature oven, and the merit of neither contaminating nor corroding the inner wall of the plasma production container with the melted matters.

What is claimed is:

1. An ion source comprising:

a filament configured for generating thermoelectron; and a plasma production container, in which the thermoelectron generated from the filament is used to ionize a raw gas containing indium for leading an ion beam containing indium ion;

wherein the raw gas is one of trimethylindium gas or triethylindium gas, and the filament comprises tantalum, the combination of the raw gas comprising one of trimethylindium gas or triethylindium gas, and the filament comprising tantalum causes the filament to have lifetime greater than a wolfram filament.

2. The ion source according to claim 1, further comprising:

a gas introducing mechanism for introducing an inert gas and the raw gas into the plasma production container.

3. The ion source according to claim 2, wherein the gas introducing mechanism includes a pipe.

4. A method for providing a ion source comprising:

generating thermoelectron using a filament;

ionizing a raw gas in a plasma production container using the thermoelectron generated from the filament, the raw gas containing indium for leading an ion beam containing indium ion, the raw gas comprising one of trimethylindium gas or triethylindium gas, and the filament comprising tantalum, the combination of the raw gas comprising one of trimethylindium gas or triethylindium gas, and the filament comprising tantalum causing the filament to have lifetime greater than a wolfram filament.

5. The method of claim 4, further comprising:

a gas introducing mechanism for introducing an inert gas and the raw gas into the plasma production container.

6. The method of claim 5, wherein the gas introducing mechanism includes a pipe.

* * * * *